US012486841B2

(12) United States Patent
Gledhill, III et al.

(10) Patent No.: US 12,486,841 B2
(45) Date of Patent: Dec. 2, 2025

(54) PIVOTABLE PUMP HEAD

(71) Applicant: Blue-White Industries, Ltd., Huntington Beach, CA (US)

(72) Inventors: Robert E. Gledhill, III, Huntington Beach, CA (US); Hipolito Camacho, Whittier, CA (US); John T. Nguyen, Fountain Valley, CA (US); Dennis Couch, Huntington Beach, CA (US); Patrick Michael Murphy, Irvine, CA (US)

(73) Assignee: Blue-White Industries, Ltd., Huntington Beach, CA (US)

( * ) Notice: Subject to any disclaimer, the term of this patent is extended or adjusted under 35 U.S.C. 154(b) by 372 days.

(21) Appl. No.: 18/337,297

(22) Filed: Jun. 19, 2023

(65) Prior Publication Data

US 2024/0011479 A1 Jan. 11, 2024

Related U.S. Application Data

(60) Provisional application No. 63/367,936, filed on Jul. 8, 2022.

(51) Int. Cl.
*F04B 53/16* (2006.01)
*F04B 17/03* (2006.01)
(Continued)

(52) U.S. Cl.
CPC ..... *F04B 53/16* (2013.01); *F04B 17/03* (2013.01); *F04B 43/12* (2013.01); *F04B 45/08* (2013.01)

(58) Field of Classification Search
CPC ..... F04B 53/16; F04B 17/03; F04B 43/12; F04B 43/1253; F04B 45/08; F04B 2201/124; F04B 2201/1241
See application file for complete search history.

(56) References Cited

U.S. PATENT DOCUMENTS 4,558,996 A * 12/1985 Becker ..... F04B 43/1253 417/374
7,001,153 B2 2/2006 McDowell et al.
(Continued)

FOREIGN PATENT DOCUMENTS

EP 1126177 A2 * 8/2001 ..... F04D 13/0693

*Primary Examiner* — Dominick L Plakkoottam
(74) *Attorney, Agent, or Firm* — Knobbe, Martens, Olson & Bear, LLP

(57) ABSTRACT

A pump can include a pump head, a body housing, a motor disposed within the body housing, and a motor shaft extending from the motor. The pump head can include a sensor, at least a first interface portion, and at least a first elongate conductor electrically connecting the sensor to the at least a first interface portion. The body housing can include at least a second interface portion and at least a second elongate conductor electrically connecting the at least a second interface portion to pump electronics. The sensor can be configured to sense when the at least a first interface portion does not contact the at least a second interface portion. When the at least a first interface portion does not contact the at least a second interface portion and the pump head is removed from the body housing, the pump head can be pivotable relative the motor shaft such that an orientation of the pump head can be changed with respect to the body housing.

31 Claims, 8 Drawing Sheets

(51) Int. Cl.
*F04B 43/12* (2006.01)
*F04B 45/08* (2006.01)

(56) References Cited

U.S. PATENT DOCUMENTS

| | | | | |
|---|---|---|---|---|
| 7,284,964 | B2 | 10/2007 | McDowell et al. | |
| 8,215,931 | B2 * | 7/2012 | McDowell | B25B 33/00 417/33 |
| 8,418,364 | B2 | 4/2013 | McDowell et al. | |
| 8,639,363 | B2 | 1/2014 | Gledhill, III et al. | |
| 9,374,024 | B2 | 6/2016 | Nguyen et al. | |
| 9,389,109 | B2 | 7/2016 | Gledhill, III et al. | |
| 9,777,720 | B2 | 10/2017 | Gledhill, III et al. | |
| 9,828,984 | B2 | 11/2017 | Gledhill, III et al. | |
| 9,909,579 | B2 | 3/2018 | Gledhill, III et al. | |
| 9,996,089 | B2 | 6/2018 | Gledhill, III et al. | |
| 10,330,094 | B2 | 6/2019 | Gledhill, III et al. | |
| 10,948,320 | B2 | 3/2021 | Gledhill, III et al. | |
| 11,131,300 | B2 | 9/2021 | Gledhill, III et al. | |
| 11,150,118 | B2 | 10/2021 | Gledhill, III et al. | |
| 11,221,004 | B2 | 1/2022 | Gledhill, III et al. | |
| 11,261,857 | B2 | 3/2022 | Gledhill, III et al. | |
| D959,238 | S | 8/2022 | Nguyen et al. | |
| 11,402,248 | B2 | 8/2022 | Gledhill, III et al. | |
| 11,485,653 | B2 | 11/2022 | Gledhill, III et al. | |
| 11,578,716 | B2 | 2/2023 | Gledhill, III et al. | |
| 11,639,863 | B2 | 5/2023 | Nguyen et al. | |
| 11,703,362 | B2 | 7/2023 | Nguyen et al. | |
| 11,754,065 | B2 | 9/2023 | Nguyen et al. | |
| 2010/0005655 | A1 | 1/2010 | Nguyen | |
| 2011/0180172 | A1 | 7/2011 | Gledhill, III et al. | |
| 2015/0093270 | A1 * | 4/2015 | Jones | F04B 9/103 417/420 |
| 2015/0211509 | A1 | 7/2015 | Gledhill, III et al. | |
| 2015/0240804 | A1 * | 8/2015 | Dehmer | F04B 53/22 96/155 |
| 2016/0017880 | A1 * | 1/2016 | Maguire | F04B 49/06 417/410.3 |
| 2018/0238924 | A1 * | 8/2018 | Wang | F04B 49/06 |
| 2018/0291886 | A1 | 10/2018 | Gledhill, III et al. | |
| 2018/0298891 | A1 | 10/2018 | Gledhill, III et al. | |
| 2021/0054963 | A1 | 2/2021 | Nguyen et al. | |
| 2021/0064735 | A1 | 3/2021 | Gledhill, III et al. | |
| 2021/0348602 | A1 | 11/2021 | Nguyen et al. | |
| 2021/0363978 | A1 * | 11/2021 | Zhang | F04B 49/00 |
| 2022/0099083 | A1 | 3/2022 | Gledhill, III et al. | |
| 2022/0276082 | A1 | 9/2022 | Gledhill, III et al. | |
| 2022/0316463 | A1 | 10/2022 | Gledhill, III et al. | |
| 2023/0058600 | A1 * | 2/2023 | Hill | F04B 49/12 |

* cited by examiner

PIVOTABLE PUMP HEAD

INCORPORATION BY REFERENCE TO ANY PRIORITY APPLICATIONS

This application claims priority to U.S. Provisional Application No. 63/367,936, filed Jul. 8, 2022, and entitled "PIVOTABLE PUMP HEAD," the disclosure of which is hereby incorporated by reference in its entirety.

BACKGROUND

Field

The present disclosure relates generally to pivotable pump heads. More particularly, the present disclosure relates to pumps with a pivotable pump head and methods of changing an orientation of a pump head on a pump.

Description of the Related Art

FIG. 1 is a perspective view of an example peristaltic pump. The example pump 1 has a pump head 2 and a body housing 4. A rotor 5 can compress a pump tubing (within the pump head 2) against an inner surface of the pump head 2 in a peristaltic squeezing action as the rotor 5 rotates, thereby driving fluid through the pump tubing from a first fluid port 6 to a second fluid port 8. The dimensions of the pump tubing and the rotational speed of the rotor 5 can determine the volumetric output of the pump 1. Based on the user's needs, it may be desirable to be able to change the orientation of the pump head 2 with respect to the body housing 4. For example, it may be desirable to change the orientation of the pump head 2 such that the first fluid port 6 and/or the second fluid port 8 faces a different direction.

SUMMARY

One aspect of the present invention is the recognition that users who attempt to rotate the pump head 2 themselves run the risk of damaging one or more pump parts (e.g., a sensor and/or one or more wires extending from the pump head 2 to the body housing 4), compromising the safety and performance of the pump.

In various implementations, a pump is provided. The pump can include a body housing, a motor disposed within the body housing, pump electronics configured to operate the motor, a motor shaft extending from the motor, and a pump head removable from the body housing. The pump head can include a sensor, at least one first connector plate, and at least one first wire electrically connecting the sensor to the at least one first connector plate. The body housing can include at least one second connector plate and at least one second wire electrically connecting the at least one second connector plate to the pump electronics. The sensor can be configured to sense when the pump head is removed from the body housing when the at least one first connector plate does not contact the at least one second connector plate. When the pump head is removed from the body housing, the pump head can be pivotable relative the motor shaft such that an orientation of the pump head can be changed with respect to the body housing.

In some pumps, the body housing can define a wall radially surrounding a motor shaft opening in the body housing and (a) the at least one second connector plate can be a component of the body housing and can be disposed on the wall of the body housing or (b) the at least one second connector plate can be a component of the body housing and can be removable from the wall of the body housing.

In various implementations, the pump electronics can be configured to operate the motor in a maintenance mode when the sensor senses the at least one first connector plate does not contact the at least one second connector plate.

In various implementations, the pump electronics can be configured to operate the motor at a higher rate of speed than the maintenance mode when the sensor senses the at least one first connector plate contacts the at least one second connector plate.

In some instances, the sensor can comprise a reed switch.

In some pumps, the at least one first wire does not extend beyond the at least one first connector plate of the pump head on a side facing the body housing.

In some pumps, the at least one second wire does not extend beyond the at least one second connector plate on a side facing the pump head.

In some instances, the pump can be a peristaltic pump.

In various implementations, a pump is provided. The pump can include a pump head, a body housing, a motor disposed within the body housing, and a motor shaft extending from the motor. The pump head can include a sensor, at least a first interface portion, and at least a first elongate conductor electrically connecting the sensor to the at least a first interface portion. The body housing can include at least a second interface portion and at least a second elongate conductor electrically connecting the at least a second interface portion to pump electronics. The sensor can be configured to sense when the at least a first interface portion does not contact the at least a second interface portion. When the at least a first interface portion does not contact the at least a second interface portion and the pump head is removed from the body housing, the pump head can be pivotable relative the motor shaft such that an orientation of the pump head can be changed with respect to the body housing.

In some pumps, the at least a second interface portion can include a first surface facing outward from the body housing and a second surface opposite the first surface. The at least a second elongate conductor can be disposed on the second surface.

In various implementations, the body housing can define a wall radially surrounding a motor shaft opening in the body housing and the pump head can define a wall radially surrounding a motor shaft opening in the pump head and at least one of (a) the at least a first interface portion can be a component of the pump head and can be removable from the wall of the pump head and (b) the at least a second interface portion can be a component of the body housing and can be removable from the wall of the body housing.

In various implementations, the body housing can define a wall radially surrounding a motor shaft opening in the body housing and (a) the at least a second interface portion can be a component of the body housing and can be disposed on the wall of the body housing or (b) the at least a second interface portion can be a component of the body housing and can be removable from the wall of the body housing. As an example, the wall can be an outer wall of the body housing and the at least a second interface portion can be disposed on the outer wall of the body housing. As another example, the wall can be an intermediate wall of the body housing and the at least a second interface portion can be disposed on an outer wall removable from the intermediate wall of the body housing.

Some pumps can further include pump electronics configured to operate the motor. The pump electronics can be disposed within the body housing.

In some instances, the pump electronics can be configured to operate the motor in a maintenance mode when the sensor senses the at least a first interface portion does not contact the at least a second interface portion.

In some pumps, the at least a first interface portion and the at least a second interface portion can each comprise a conductive section disposed with respect to an axis of the motor shaft so as to span an angle of at least 45 degrees with respect to the motor shaft when the pump head is mounted to the body housing.

In some pumps, the pump electronics can be configured to operate the motor at a higher rate of speed than the maintenance mode when the sensor senses the at least a first interface portion contacts the at least a second interface portion.

In some instances, the sensor can comprise a reed switch.

In some pumps, the at least a first interface portion and the at least a second interface portion can each comprise two arcuate sections disposed about an axis of the motor shaft.

In various instances, the at least a first elongate conductor does not extend beyond the at least a first interface portion of the pump head on a side facing the body housing.

In various instances, the at least a second elongate conductor does not extend beyond the at least a second interface portion on a side facing the pump head.

In some pumps, when the pump head is removed from the body housing, the pump head can be pivotable 360° about an axis of the motor shaft.

In some instances, the pump can be a peristaltic pump.

In various implementations, a method of changing an orientation of a pump head on a pump is provided. The method can include providing a pump. The pump can include a pump head, a body housing, a motor disposed within the body housing, and a motor shaft extending from the motor. The pump head can include a sensor, at least a first interface portion, and at least a first elongate conductor electrically connecting the sensor to the at least a first interface portion. The body housing can include at least a second interface portion and at least a second elongate conductor electrically connecting the at least a second interface portion to pump electronics. The method can include removing the pump head from the body housing. The method can also include sensing, with the sensor, when the at least a first interface portion does not contact the at least a second interface portion. The method can also include pivoting the pump head relative the motor shaft to change an orientation of the pump head with respect to the body housing. The method can further include placing the pump head on the body housing.

In some methods, the body housing can define a wall radially surrounding a motor shaft opening in the body housing and (a) the at least a second interface portion can be a component of the body housing and can be disposed on the wall of the body housing or (b) the at least a second interface portion can be a component of the body housing and can be removable from the wall of the body housing.

Some methods can include operating the motor in a maintenance mode after sensing the at least a first interface portion does not contact the at least a second interface portion.

In some methods, placing the pump head on the body housing can include contacting the at least a first interface portion with the at least a second interface portion.

Some method can include operating the motor at a higher rate of speed than a maintenance mode after sensing the at least a first interface portion contacts the at least a second interface portion.

In various instances, when the pump head is removed from the body housing, the pump head can be pivotable 360° about the motor shaft.

In some methods, the pump can be a peristaltic pump.

BRIEF DESCRIPTION OF THE DRAWINGS

The features disclosed herein are described below with reference to the drawings of some implementations. The illustrated implementations are intended to illustrate, but not to limit the inventions. The drawings contain the following figures.

DETAILED DESCRIPTION

While the present description sets forth specific details of various implementations, it will be appreciated that the description is illustrative only and should not be construed in any way as limiting. Furthermore, various applications of such implementations and modifications thereto, which may occur to those who are skilled in the art, are also encompassed by the general concepts described herein.

Figure 1:
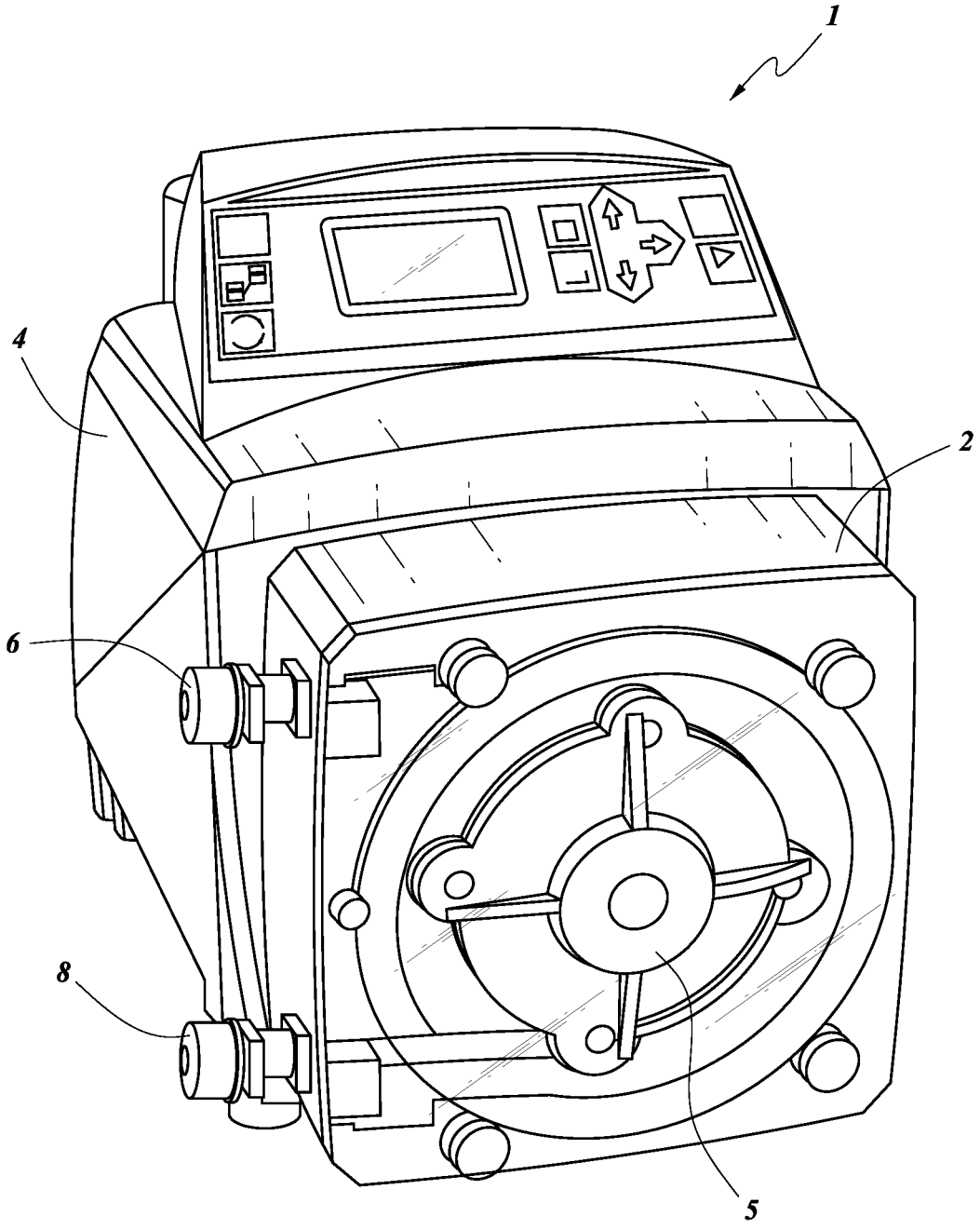
FIG. 1 is a perspective view of a peristaltic pump.
Figure 2A:
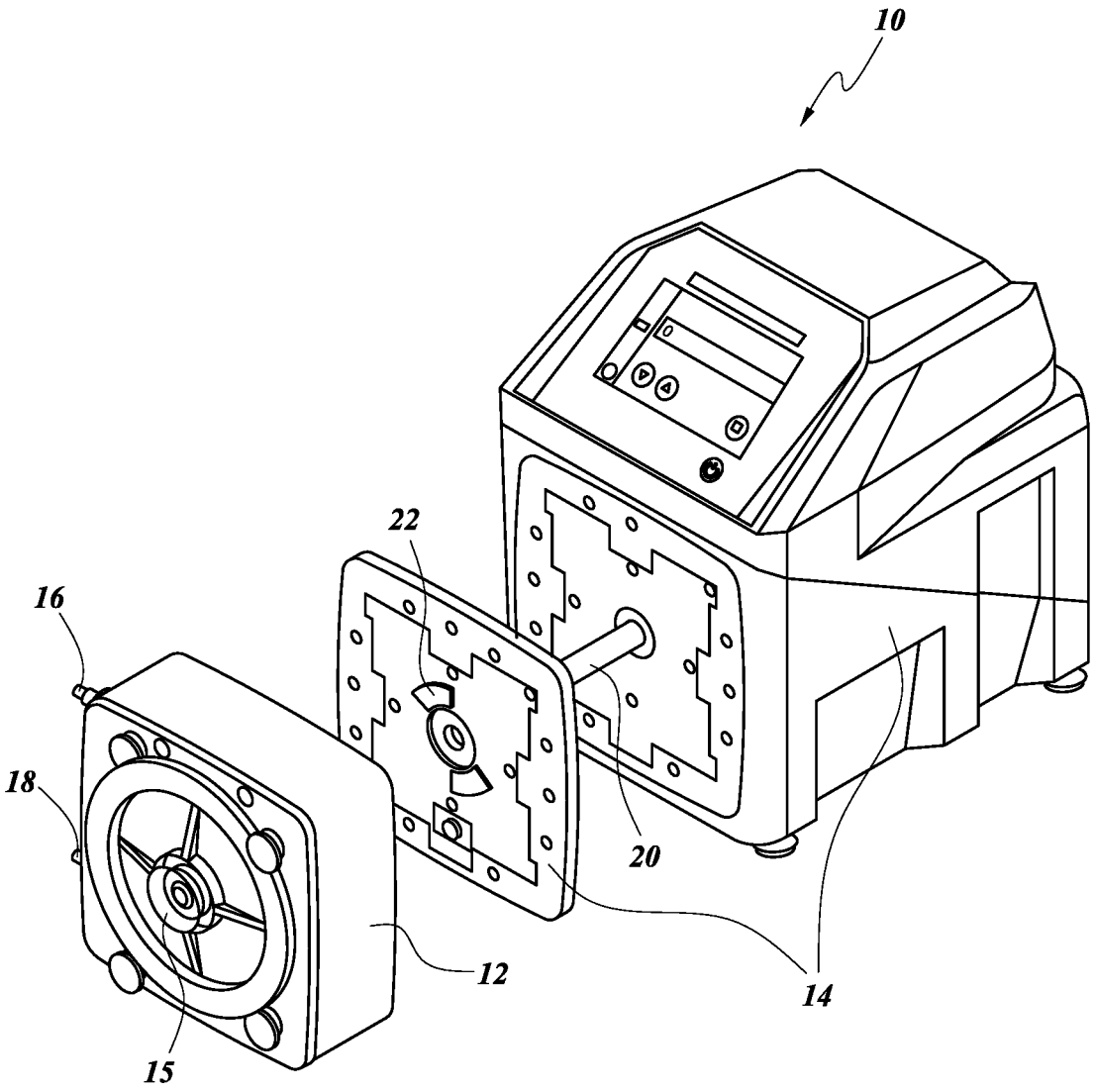
FIGS. 2A and 2B are exploded perspective views of components of an example pump according to certain implementations described herein.
Figure 2B:
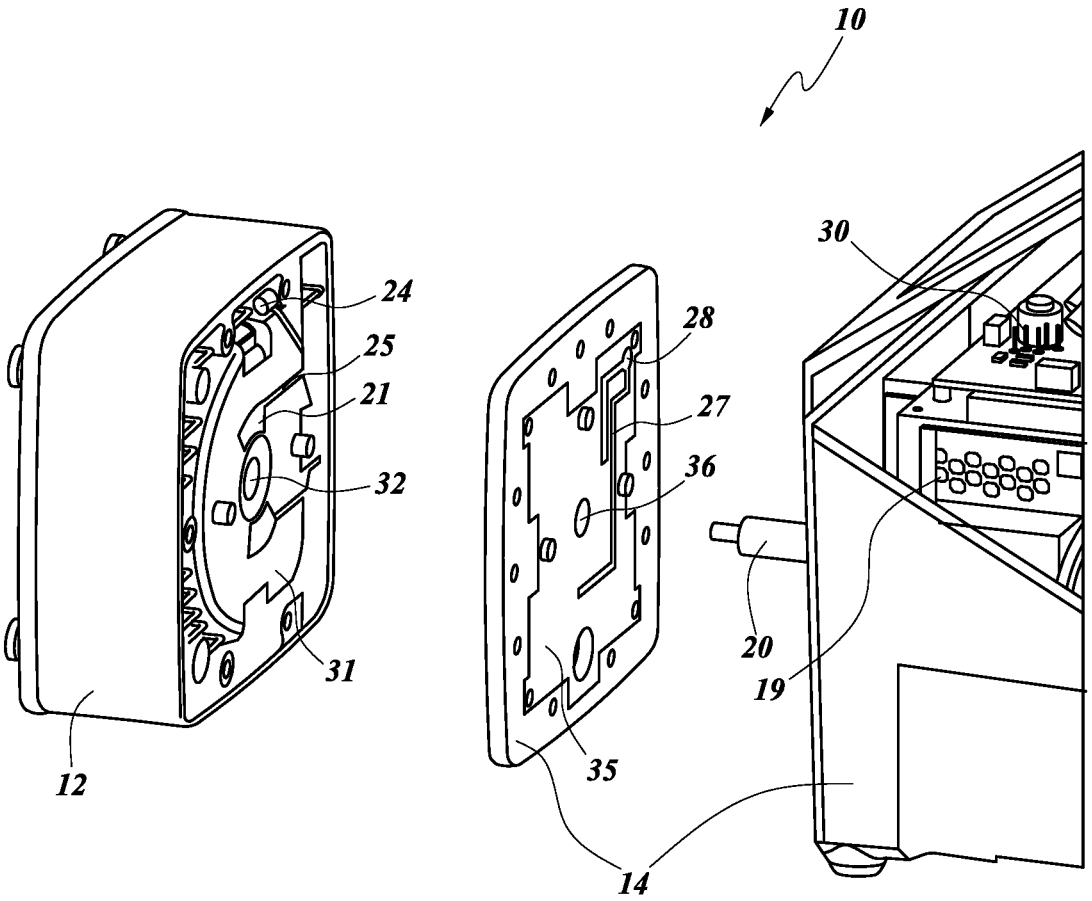

Various pumps similar to the pump shown in FIG. 1 can be provided with a pivotable pump head. FIGS. 2A and 2B are exploded perspective views of an example pump 10 that can include a pivotable pump head according to various implementations described herein. The illustrated pump 10 is a peristaltic pump similar to pump 1 shown in FIG. 1. However, other types of pumps can include a pivotable pump head as described herein. FIGS. 2A and 2B are front and back views respectively. Similar to FIG. 1, the pump 10 can have a pump head 12 and a body housing 14. In various instances, the pump 10 can include a rotor 15 configured to compress a pump tubing (within the pump head 12) against an inner surface of the pump head 12 to drive fluid through the pump tubing extending from a first fluid port 16 to a second fluid port 18 (or vice versa) as the rotor 15 rotates. The rotor 15 can be operated by a motor 19 disposed within the body housing 14. The rotor 15 can be connected to the motor 19 via a motor shaft 20 extending from the motor 19. As will be described herein, in various implementations, users can change the orientation of the pump head 12 with respect to the body housing 14 by pivoting the pump head 12 relative the motor shaft 20 with reduced risk of damaging one or more pump parts (e.g., a sensor and/or one or more wires) extending between the pump head 12 and body housing 14.

As shown in FIGS. 2A and 2B, the pump head 12 can include at least a first interface portion 21 (FIG. 2B) and the body housing 14 can include at least a second interface portion 22 (FIG. 2A). When assembled with the pump head 12 disposed on the body housing 14, the first interface portion 21 (e.g., at least one first connector plate) can contact the second interface portion 22 (e.g., at least one second connector plate). In various implementations, the first interface portion 21 can provide an electrical connection with the second interface portion 22 when the pump head 12 is disposed on the body housing 14.

In various implementations, as shown in FIG. 2B, the pump 10 can include a sensor 24 configured to sense when the pump head 12 is removed from the body housing 14, e.g., when the first interface portion 21 does not contact the second interface portion 22. The sensor 24 can be electrically connected to the first interface portion 21 via at least a first elongate conductor 25 (e.g., at least one first wire). As shown in FIG. 2B, the body housing 14 can include at least a second elongate conductor 27 (e.g., at least one second wire) electrically connecting the second interface portion 22 to pump electronics 30. The pump electronics 30 can be configured to operate the motor 19 disposed within the body housing 14. As an example, the second elongate conductor 27 can extend at a location 28 toward the pump electronics 30.

In various implementations, instead of a sensor and/or wire (e.g., a sensor wire) extending between the pump head 12 and the body housing 14, the pump head 12 and the body housing 14 can be electrically connected via the first 21 and the second 22 interface portions. When the first interface portion 21 does not contact the second interface portion 22 and the pump head 12 is removed from the body housing 14, the pump head 12 can be pivotable relative the motor shaft 20 such that an orientation of the pump head 12 can be changed with respect to the body housing 14. In some implementations, when the pump head 12 is removed from the body housing 14, the pump head 12 can be pivotable 360° about an axis of the motor shaft 20.

In reference to FIG. 2B, the pump head 12 can define a wall radially surrounding a motor shaft opening 32 in the pump head 12. In various instances, the first interface portion 21 can be disposed on the wall 31, e.g., the first interface portion 21 can be disposed on the wall 31 on a surface facing the body housing 14. The sensor 24 and/or the first elongate conductor 25 can be disposed on the wall 31, e.g., in a groove in the wall 31 as shown in FIG. 2B. Other examples are possible. For example, the sensor 24 and/or the first elongate conductor 25 can be disposed within the pump head 12, e.g., on the wall 31 on a surface opposite the surface facing the body housing 14.

As another example, in some instances, the first interface portion 21 can be a component of the pump head 12 and can be removable from the wall of the pump head 12. For example, the wall can be an intermediate wall and the first interface portion 21 can be disposed on an outer wall 31 removable from the intermediate wall of the pump head 12. As shown in FIG. 2B, in some instances, the first elongate conductor 25 does not extend beyond the at least a first interface portion 21 of the pump head 12 on a side facing the body housing 14.

As shown in FIGS. 2A and 2B, the first interface portion 21 (shown in FIG. 2B) can be configured to contact the second interface portion 22 (shown in FIG. 2A). With continued reference to FIG. 2B, the body housing 14 can define a wall radially surrounding a motor shaft opening 36 in the body housing 14. In various instances, the second interface portion 22 (FIG. 2A) can be a component of the body housing 14 and can be disposed on the wall 35. For example, the second interface portion 22 can be disposed on the wall 35 (e.g., an outer wall) on a surface facing the pump head 12, e.g., facing the first interface portion 21.

In various implementations, the second elongate conductor 27 can also be disposed on the wall 35 of the body housing 14. For example, as shown in FIG. 2B, the second elongate conductor 27 can be disposed on the wall 35, e.g., in a groove of the wall 35, on a surface opposite the surface facing the pump head 12. As another example, the second elongate conductor 27 can be disposed on the wall 35, e.g., in a groove of the wall 35, on a surface facing the pump head 12.

In some instances, the second interface portion 22 can be a component of the body housing 14 and can be removable from the wall of the body housing 14. For example, the wall can be an intermediate wall and the second interface portion 22 can be disposed on an outer wall 35 removable from the intermediate wall of the body housing 14.

As shown in FIG. 2B, in various implementations, the second elongate conductor 27 does not extend beyond the second interface portion 22 on a side facing the pump head 12. In various implementations, instead of a sensor and/or wire (e.g., a sensor wire) extending between the pump head 12 and the body housing 14, the pump head 12 and the body housing 14 can be electrically connected via the first 21 and the second 22 interface portions.

FIGS. 2A and 2B show the first interface portion 21 as two arcuate sections disposed with respect to an axis of the motor shaft opening 32 in the pump head 12 and the second interface portion 22 as two arcuate sections disposed with respect to an axis of the motor shaft opening 36 in the body housing 14. However, other examples are possible. For example, the first interface portion 21 and the second interface portion 22 can have any number of sections. As an example, the first interface portion 21 can include one, two, three, four, five, six, or more sections disposed with respect to an axis of the motor shaft opening 32 in the pump head 12 (or the motor shaft 20 when the pump head 12 is mounted to the body housing 14). The second interface portion 22 also can include one, two, three, four, five, six, or more sections disposed with respect to an axis of the motor shaft opening 36 in the body housing 14 (or the motor shaft 20 when the pump head 12 is mounted to the body housing 14). The number of sections for the first interface portion 21 and the number of sections for the second interface portion 22 can be the same or different. In addition, the shape and size of the first interface portion 21 and the second interface portion 22 do not limit this disclosure.

In various implementations, the first interface portion 21 can include at least one first connector plate. In various implementations, the first interface portion 21 can include at least one electrically conductive plate. In some instances, the first interface portion 21 can include at least one metal plate. Similarly, in various implementations, the second interface portion 22 can include at least one second connector plate. In various implementations, the second interface portion 22 can include at least one electrically conductive plate. In some instances, the second interface portion 22 can include at least one metal plate.

In various implementations, the first interface portion 21 can comprise a conductive section disposed with respect to the axis of the motor shaft 20 so as to span an angle of at least 45 degrees, at least 90 degrees, at least 135 degrees, at least 180 degrees, at least 225 degrees, at least 270 degrees, at least 315 degrees, or 360 degrees with respect to the motor shaft 20 when the pump head 12 is mounted to the body housing 14. In various implementations, the second interface portion 22 can comprise a conductive section disposed with respect to the axis of the motor shaft 20 so as to span an angle of at least 45 degrees, at least 90 degrees, at least 135 degrees, at least 180 degrees, at least 225 degrees, at least 270 degrees, at least 315 degrees, or 360 degrees with respect to the motor shaft 20 when the pump head 12 is mounted to the body housing 14. Other examples are possible. The span for the first interface portion 21 and the span for the second interface portion 22 can be the same or different.

When the first interface portion 21 contacts the second interface portion 22, the portions can overlap each other, for example by at least 5% to 100% overlap, e.g., at least 5%, at least 15%, at least 25%, at least 50%, at least 60%, at least 70%, at least 80%, at least 90%, or 100% overlap. Other examples are possible.

Figure 3A:
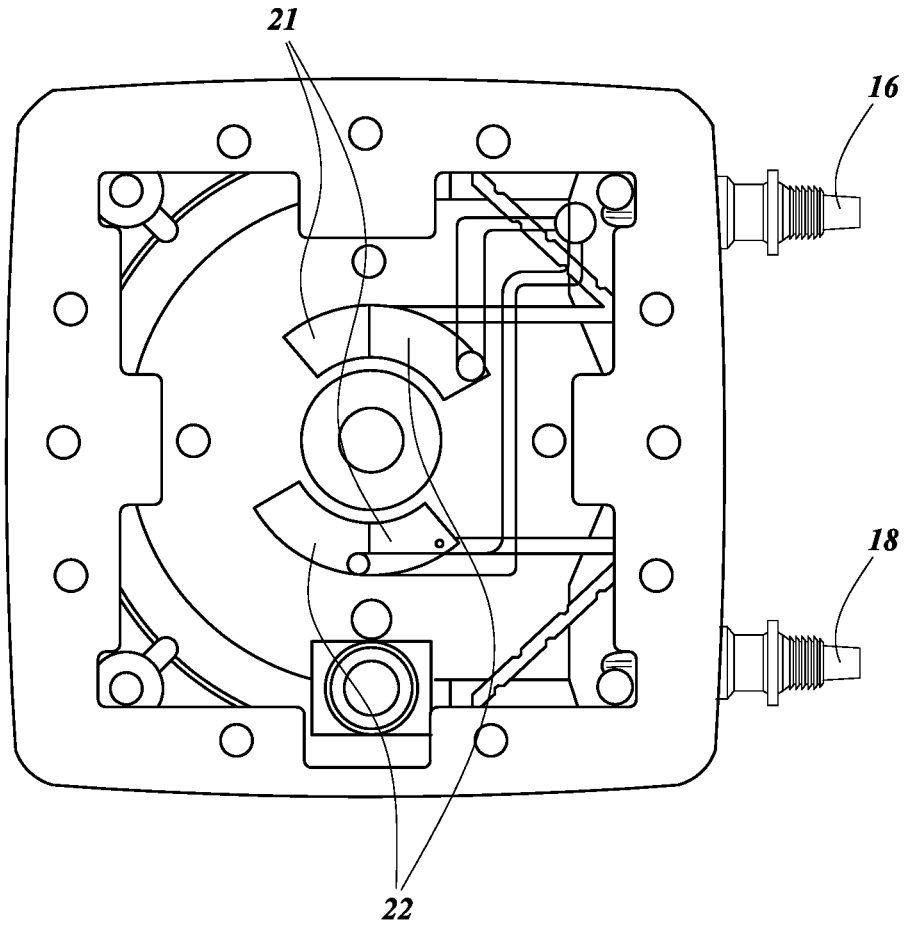
FIGS. 3A, 3B, and 3C are views of at least a first interface portion in connection with at least a second interface portion according to certain implementations described herein.
Figure 3B:
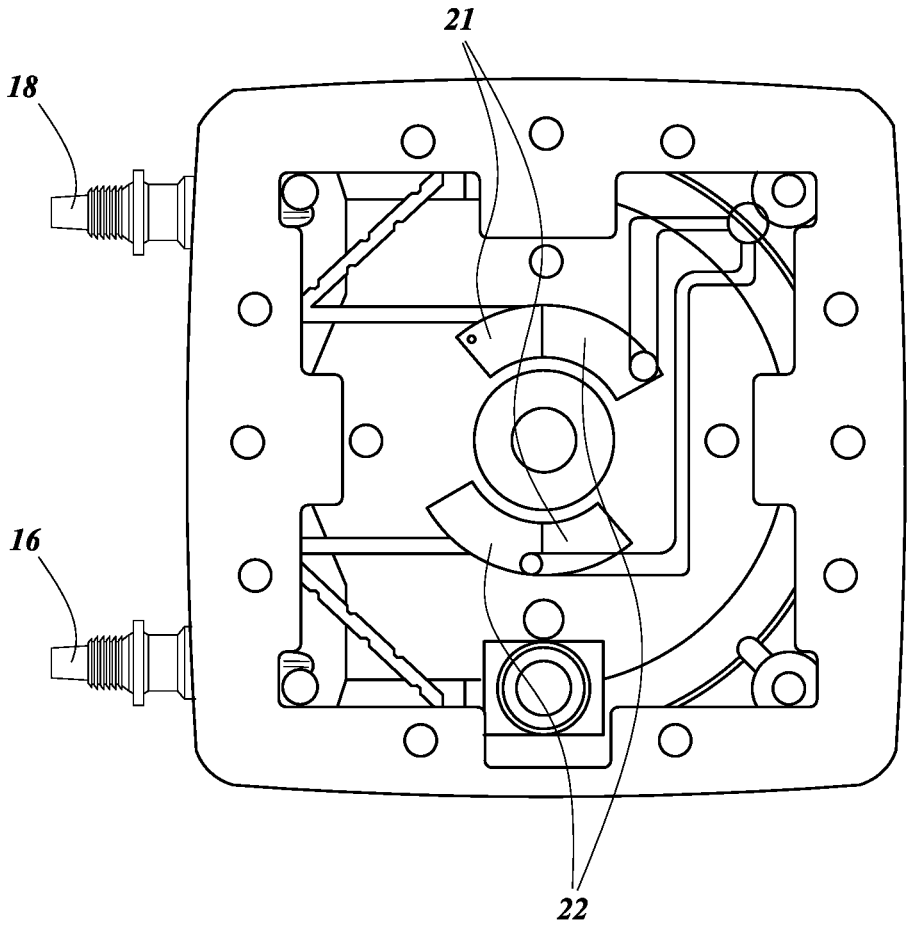
Figure 3C:
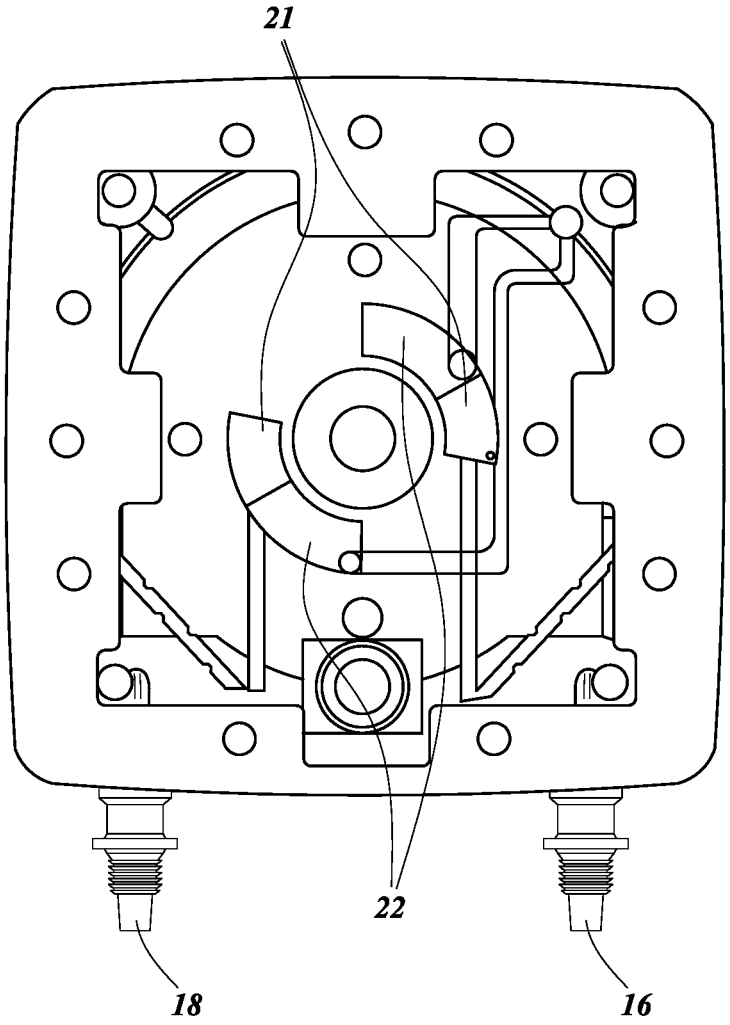

FIGS. 3A, 3B, and 3C are views of the first interface portion 21 in connection with the second interface portion 22 according to certain implementations described herein. In FIG. 3A, the first interface portions 21 are in connection with the second interface portions 22 with the first fluid port 16 and the second fluid port 18 facing a first direction. FIG. 3B shows the pump head rotated 180 degrees (clockwise or counterclockwise) about an axis of the motor shaft from FIG. 3A. The first interface portions 21 are in connection with the second interface portions 22 with the first fluid port 16 and the second fluid port 18 facing an opposite direction from FIG. 3A. FIG. 3C shows the pump head rotated 90 degrees clockwise or 270 degrees counterclockwise about an axis of the motor shaft from FIG. 3A. The first interface portions 21 are in connection with the second interface portions 22 with the first fluid port 16 and the second fluid port 18 facing a direction 90 degrees clockwise about an axis of the motor shaft from FIG. 3A. The pump head can also be rotated 90 degrees counterclockwise or 270 degrees clockwise about an axis of the motor shaft from FIG. 3A such that the first fluid port 16 and the second fluid port 18 face a direction opposite that of FIG. 3C.

The pump head shown in these examples have a cross section of a square. Other cross sections and angles are possible. For example, some implementations may have a circular cross section and the pump head can be pivoted about an axis of the motor shaft at any angle from between 0 and 360 degrees.

In FIGS. 3A-3C, as the pump head and the first interface portions 21 pivots, the second interface portions 22 remains fixed. In some examples, the second interface portion 22 may also be pivotable.

Referring back to FIGS. 2A and 2B, the sensor 24 can be any sensor known in the art or yet to be developed. In some instances, it is desirable that the sensor 24 is a reed switch. The first elongate conductor 25 and/or the second elongate conductor 27 can be one or more electrical wires. The pump electronics 30 and/or the motor 19 can be any pump electronics and/or motor known in the art or yet to be developed.

In various implementations, as shown in FIG. 2B, the sensor 24 can be configured to sense when the pump head 12 is removed from the body housing 14, e.g., when the first interface portion 21 does not contact the second interface portion 22. For safety, when the sensor 24 senses that the pump head 12 is removed from the body housing 14, e.g., when the first interface portion 21 does not contact the second interface portion 24, the pump electronics 30 can be configured to operate the motor 19 in a maintenance mode (e.g., at a reduced or limited motor speed).

When the first interface portion 21 does not contact the second interface portion 22 and the pump head 12 is removed from the body housing 14, the pump head 12 can be pivotable relative the motor shaft 20 such that an orientation of the pump head 12 can be changed with respect to the body housing 14.

The sensor 24 can also be configured to sense when the first interface portion 21 contacts the second interface portion 22. When the sensor 24 senses that the pump head 12 is disposed on the body housing 14, e.g., when the first interface portion 21 contacts the second interface portion 22, the pump electronics 30 can be configured to operate the motor at a higher rate of speed (e.g., a normal mode) than the maintenance mode.

Figure 4:
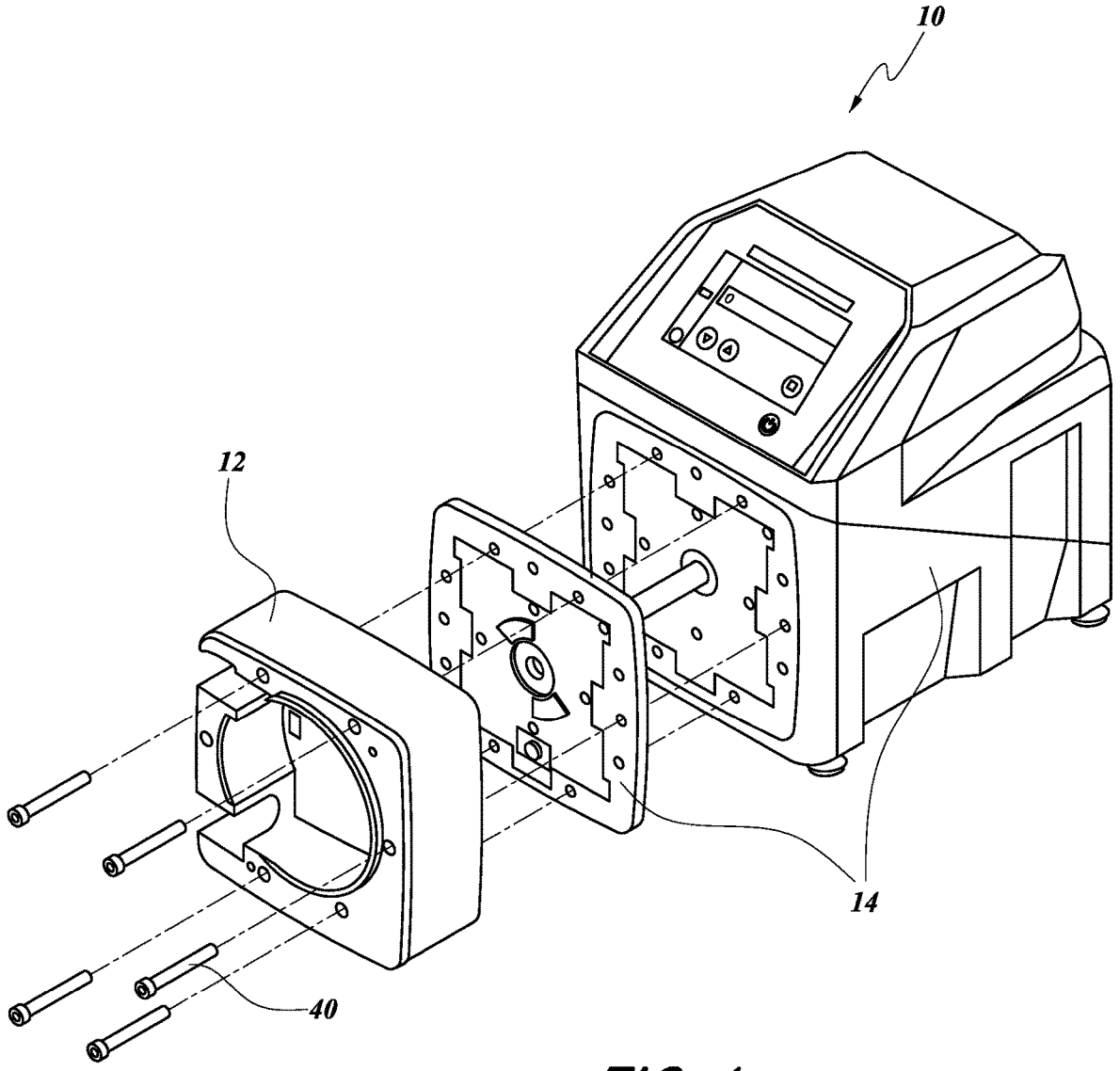
FIG. 4 is an exploded perspective view of an example pump including fasteners connecting the pump head to the body housing according to certain implementations described herein.

In various implementations, the pump head 12 can be connected to the body housing 14 using any connectors known in the art or yet to be developed. For example, as shown in FIG. 4, the pump head 12 can be attached to the body housing 14 using fasteners 40. The pump head 12 can be removed from the body housing 14 by removing one or more of the fasteners 40. In some instances, the fasteners 40 can be screws. Other examples are possible.

Figure 5:
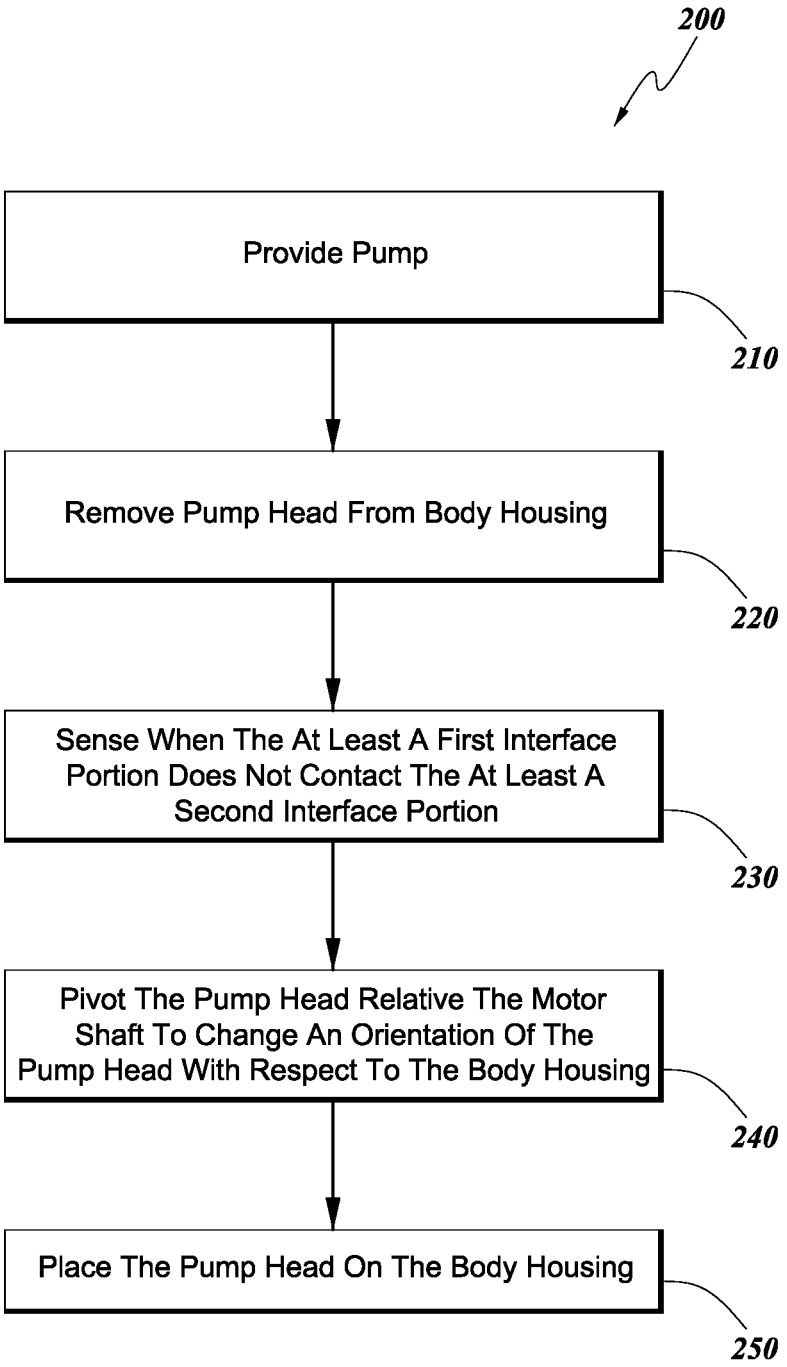
FIG. 5 illustrates a method of changing an orientation of a pump head on a pump according to certain implementations described herein.

As described herein, various pumps can allow users to change the orientation of the pump head with respect to the body housing. FIG. 5 shows a flowchart of an example method of changing an orientation of a pump head on a pump. The method 200 can include providing a pump, as shown in block 210. The pump can include any of the pumps (e.g., peristaltic pump) described herein. For example, the pump can include a pump head, a body housing, a motor disposed within the body housing, and a motor shaft extending from the motor. The pump head can comprise a sensor, at least a first interface portion, and at least a first elongate conductor electrically connecting the sensor to the at least a first interface portion. The body housing can comprise at least a second interface portion and at least a second elongate conductor electrically connecting the at least a second interface portion to pump electronics.

As shown in block 220, the method 200 can include removing the pump head from the body housing. The method 200 can also include sensing, with the sensor, when the at least a first interface portion does not contact the at least a second interface portion, as shown in block 230. Further, as shown in block 240, the method 200 can include pivoting the pump head relative the motor shaft to change an orientation of the pump head with respect to the body housing. The method 200 can also include placing the pump head on the body housing, as shown in block 250.

Some methods can comprise operating the motor in a maintenance mode after sensing the at least a first interface portion does not contact the at least a second interface portion. In some instances, when the pump head is removed from the body housing, the pump head can be pivotable 360° about the motor shaft. In some methods, placing the pump head on the body housing can comprise contacting the at least a first interface portion with the at least a second interface portion. In some instances, the method can comprise operating the motor at a higher rate of speed than the maintenance mode after sensing the at least a first interface portion contacts the at least a second interface portion.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A pump comprising:

a body housing;

a motor disposed within the body housing;

pump electronics configured to operate the motor;

a motor shaft extending from the motor; and a pump head removable from the body housing, wherein the pump head comprises a sensor, at least one first connector plate, and at least one first wire electrically connecting the sensor to the at least one first connector plate, wherein the body housing comprises at least one second connector plate and at least one second wire electrically connecting the at least one second connector plate to the pump electronics, wherein the sensor is configured to sense when the pump head is removed from the body housing when the at least one first connector plate does not contact the at least one second connector plate, and wherein, when the pump head is removed from the body housing, the pump head is pivotable relative the motor shaft such that an orientation of the pump head can be changed with respect to the body housing.

2. The pump of claim 1, wherein the body housing defines a wall radially surrounding a motor shaft opening in the body housing and (a) the at least one second connector plate is a component of the body housing and is disposed on the wall of the body housing or (b) the at least one second connector plate is a component of the body housing and is removable from the wall of the body housing.

3. The pump of claim 1, wherein the pump electronics are configured to operate the motor in a maintenance mode when the sensor senses the at least one first connector plate does not contact the at least one second connector plate.

4. The pump of claim 3, wherein the pump electronics are configured to operate the motor at a higher rate of speed than the maintenance mode when the sensor senses the at least one first connector plate contacts the at least one second connector plate.

5. The pump of claim 1, wherein the sensor comprises a reed switch.

6. The pump of claim 1, wherein the at least one first wire does not extend beyond the at least one first connector plate of the pump head on a side facing the body housing.

7. The pump of claim 1, wherein the at least one second wire does not extend beyond the at least one second connector plate on a side facing the pump head.

8. The pump of claim 1, wherein the pump is a peristaltic pump.

9. A pump comprising:

a pump head comprising a sensor, at least a first interface portion, and at least a first elongate conductor electrically connecting the sensor to the at least a first interface portion;

a body housing comprising at least a second interface portion and at least a second elongate conductor electrically connecting the at least a second interface portion to pump electronics;

a motor disposed within the body housing; and a motor shaft extending from the motor, wherein the sensor is configured to sense when the at least a first interface portion does not contact the at least a second interface portion, and wherein, when the at least a first interface portion does not contact the at least a second interface portion and the pump head is removed from the body housing, the pump head is pivotable relative the motor shaft such that an orientation of the pump head can be changed with respect to the body housing.

10. The pump of claim 9, wherein the at least a second interface portion comprises a first surface facing outward from the body housing and a second surface opposite the first surface, wherein the at least a second elongate conductor is disposed on the second surface.

11. The pump of claim 9, wherein the body housing defines a wall radially surrounding a motor shaft opening in the body housing and the pump head defines a wall radially surrounding a motor shaft opening in the pump head and at least one of (a) the at least a first interface portion is a component of the pump head and is removable from the wall of the pump head and (b) the at least a second interface portion is a component of the body housing and is removable from the wall of the body housing.

12. The pump of claim 9, wherein the body housing defines a wall radially surrounding a motor shaft opening in the body housing and (a) the at least a second interface portion is a component of the body housing and is disposed on the wall of the body housing or (b) the at least a second interface portion is a component of the body housing and is removable from the wall of the body housing.

13. The pump of claim 12, wherein the wall is an outer wall of the body housing and the at least a second interface portion is disposed on the outer wall of the body housing.

14. The pump of claim 12, wherein the wall is an intermediate wall of the body housing and the at least a second interface portion is disposed on an outer wall removable from the intermediate wall of the body housing.

15. The pump of claim 9, further comprising the pump electronics configured to operate the motor, wherein the pump electronics are disposed within the body housing.

16. The pump of claim 15, wherein the pump electronics are configured to operate the motor in a maintenance mode when the sensor senses the at least a first interface portion does not contact the at least a second interface portion.

17. The pump of claim 9, wherein the at least a first interface portion and the at least a second interface portion each comprise a conductive section disposed with respect to an axis of the motor shaft so as to span an angle of at least 45 degrees with respect to the motor shaft when the pump head is mounted to the body housing.

18. The pump of claim 16, wherein the pump electronics are configured to operate the motor at a higher rate of speed than the maintenance mode when the sensor senses the at least a first interface portion contacts the at least a second interface portion.

19. The pump of claim 9, wherein the sensor comprises a reed switch.

20. The pump of claim 9, wherein the at least a first interface portion and the at least a second interface portion each comprise two arcuate sections disposed about an axis of the motor shaft.

21. The pump of claim 9, wherein the at least a first elongate conductor does not extend beyond the at least a first interface portion of the pump head on a side facing the body housing.

22. The pump of claim 9, wherein the at least a second elongate conductor does not extend beyond the at least a second interface portion on a side facing the pump head.

23. The pump of claim 9, wherein, when the pump head is removed from the body housing, the pump head is pivotable 360° about an axis of the motor shaft.

24. The pump of claim 9, wherein the pump is a peristaltic pump.

25. A method of changing an orientation of a pump head on a pump, the method comprising:

providing a pump, the pump comprising:

a pump head comprising a sensor, at least a first interface portion, and at least a first elongate conductor electrically connecting the sensor to the at least a first interface portion;

a body housing comprising at least a second interface portion and at least a second elongate conductor electrically connecting the at least a second interface portion to pump electronics;

a motor disposed within the body housing; and a motor shaft extending from the motor;

removing the pump head from the body housing;

sensing, with the sensor, when the at least a first interface portion does not contact the at least a second interface portion;

pivoting the pump head relative the motor shaft to change an orientation of the pump head with respect to the body housing; and placing the pump head on the body housing.

26. The method of claim 25, wherein the body housing defines a wall radially surrounding a motor shaft opening in the body housing and (a) the at least a second interface portion is a component of the body housing and is disposed on the wall of the body housing or (b) the at least a second interface portion is a component of the body housing and is removable from the wall of the body housing.

27. The method of claim 25, comprising operating the motor in a maintenance mode after sensing the at least a first interface portion does not contact the at least a second interface portion.

28. The method of claim 25, wherein placing the pump head on the body housing comprises contacting the at least a first interface portion with the at least a second interface portion.

29. The method of claim 25, comprising operating the motor at a higher rate of speed than a maintenance mode after sensing the at least a first interface portion contacts the at least a second interface portion.

30. The method of claim 25, wherein, when the pump head is removed from the body housing, the pump head is pivotable 360° about the motor shaft.

31. The method of claim 25, wherein the pump is a peristaltic pump.

* * * * *